US007035796B1

(12) United States Patent
Zhang et al.

(10) Patent No.: US 7,035,796 B1
(45) Date of Patent: Apr. 25, 2006

(54) SYSTEM FOR NOISE SUPPRESSION, TRANSCEIVER AND METHOD FOR NOISE SUPPRESSION

(75) Inventors: Ming Zhang, Singapore (SG); Hui Lan, Singapore (SG)

(73) Assignee: Nanyang Technological University, Singapore (SG)

( * ) Notice: Subject to any disclaimer, the term of this patent is extended or adjusted under 35 U.S.C. 154(b) by 0 days.

(21) Appl. No.: 10/275,460

(22) PCT Filed: May 6, 2000

(86) PCT No.: PCT/SG00/00062

§ 371 (c)(1),
(2), (4) Date: Jan. 14, 2003

(87) PCT Pub. No.: WO01/86639

PCT Pub. Date: Nov. 15, 2001

(51) Int. Cl.
*G10L 21/02* (2006.01)

(52) U.S. Cl. ..... 704/226

(58) Field of Classification Search ..... 704/500
See application file for complete search history.

(56) References Cited

U.S. PATENT DOCUMENTS

| | | | | |
|---|---|---|---|---|
| 4,625,083 A | | 11/1986 | Poikela | |
| 4,630,305 A | * | 12/1986 | Borth et al. | 381/94.3 |
| 4,649,505 A | | 3/1987 | Zinser, Jr. et al. | |
| 4,658,426 A | | 4/1987 | Chabries et al. | |
| 4,672,674 A | | 6/1987 | Clough et al. | |
| 4,932,063 A | | 6/1990 | Nakamura | |
| 5,029,118 A | | 7/1991 | Nakajima et al. | |
| 5,251,263 A | * | 10/1993 | Andrea et al. | 381/71.6 |
| 5,293,578 A | | 3/1994 | Nagami et al. | |
| 5,319,736 A | | 6/1994 | Hunt | |
| 5,410,606 A | | 4/1995 | Imai et al. | |
| 5,426,704 A | | 6/1995 | Tamamura et al. | |

(Continued)

FOREIGN PATENT DOCUMENTS

EP 0522213 A1 7/1991

(Continued)

OTHER PUBLICATIONS

Bernard Widrow et al., "Adaptive Noise Cancelling: Principles and Applications", Proc. IEEE, vol. 63, No. 12, Dec. 1975.

*Primary Examiner*—Susan McFadden
(74) *Attorney, Agent, or Firm*—Davidson Berquist Jackson & Gowdey, LLP

(57) ABSTRACT

A system with an accompanying method is provided to improve the signal-to-noise ratio (SNR) of noisy speech by suppressing acoustic background noise. The background noise consists of narrow band noise from rotating machine, audio signals from stereo-loudspeakers of audio entertainment device, and other ambient noise. In this system/apparatus, a microphone senses the speech intermingled with the background noise, and another microphone senses the noisy background. In addition, a measurement sensor is used to measure RPM (revolutions-per-minutes) of the rotating machine and two wires are used to acquire audio signals from the stereo-loudspeakers of the audio entertainment device. Furthermore, to provide better suppression performance for the acoustic audio signals, the characteristics of these loudspeakers are used to compensate for the distortion caused by the loudspeakers. Adaptive comb filters and adaptive FIR filters are applied to estimate the ambient noise and suppress the background noise. After processing, the system outputs the enhanced speech signal with higher SNR.

22 Claims, 4 Drawing Sheets

U.S. PATENT DOCUMENTS

| | | | | |
|---|---|---|---|---|
| 5,727,073 | A | 3/1998 | Ikeda | |
| 5,809,152 | A | 9/1998 | Nakamura et al. | |
| 5,933,495 | A * | 8/1999 | Oh | 379/406.08 |
| 6,097,820 | A * | 8/2000 | Turner | 381/94.3 |
| 6,738,480 | B1 * | 5/2004 | Berthault et al. | 381/66 |
| 6,882,734 | B1 * | 4/2005 | Watson et al. | 381/92 |
| 6,885,752 | B1 * | 4/2005 | Chabries et al. | 381/321 |

FOREIGN PATENT DOCUMENTS

| | | | |
|---|---|---|---|
| EP | 0629054 | A2 | 12/1994 |
| EP | 0629054 | A3 | 12/1994 |
| EP | 0654901 | A1 | 5/1995 |
| EP | 0 867 860 | A2 | 9/1998 |
| WO | WO 97/25833 | | 7/1997 |

* cited by examiner

SYSTEM FOR NOISE SUPPRESSION, TRANSCEIVER AND METHOD FOR NOISE SUPPRESSION

TECHNICAL BACKGROUND AND PRIOR ART

This invention relates to a system for the suppression of noise, an accompanying method or a transceiver.

In many cases, noise corrupts a speech signal and hence significantly degrades the quality of recognition of the speech signal. An example for such noise is background noise intermingled with the speech signal acquired by a microphone, a hand-free phone, a handset or the like.

It is important to recognize speech in a noisy environment, e.g. a night club, a sport club, a Karaoke room, a hands-free communication system in a vehicle, especially a car, a helicopter, a tank or the like. Furthermore, noise suppression is useful in a live reporting system, a public addressing system or the like.

The recognition of speech or voice can be done by an automatic speech recognition system or by at least one human listener.

The undesirable background noise can be of different sources. For example, making telephone calls out of a driving car, the driving noise, especially the noise of the engine, is a dynamically varying kind of noise that results in poor recognition of the speech, particularly in a hands-free speaking environment of the car. The addressee permanently hears a contaminated acoustic signal, in which the voice of the driver is included but difficult to understand. As a consequence, the driver has to speak up or take the handset of the telephone, which binds his attention to the handset and not the traffic—a very undesirable effect. Another scenario relates to signals from an audio system that worsens the recognition of the speech intermingled with the audio noise.

Moreover, there are lots of sites which need better recognition of speech and/or better understanding because of a noisy background. Some sites, additional to the above mentioned scenarios, are: airplanes, helicopters, airports, trains, buses, train stations, bus stops, construction sites, highways, streets or the like.

In [1] a concept and basic approach for adaptive noise cancellation are given. It can be used to eliminate background noise and improve a signal-to-noise-ratio (SNR). Therefore, a primary input containing a corrupted signal and a reference input containing noise correlated in some unknown way with the primary noise are used. This reference input is adaptively filtered and subtracted from the primary input to obtain the signal estimate. Adaptive filtering before subtraction allows the treatment of inputs that are deterministic or stochastic, stationary or time variable. Wiener solutions are developed to describe asymptotic adaptive performance and output SNR for stationary stochastic inputs, including single and multiple reference inputs. These solutions show that, when the reference input is free of signal and certain other conditions are met, noise in the primary input can be essentially eliminated without signal distortion. Further, it is shown that in treating periodic interference, the adaptive noise canceler acts as a notch filter with narrow bandwidth, infinite null, and the capability of tracking the exact frequency of the interference; in this case, the canceler behaves as a linear, time-invariant system, with the adaptive filter converging on a dynamic rather than a static solution.

In [2] a voice operated switch in a noisy environment is described. This switch is capable of distinguishing between voice and non-voice (noise).

In [3] an approach to improve the basic idea of [1] to eliminate cross-talk effects between noise and speech signals is presented.

In [4] an adaptive noise suppressing device is introduced. Here, the characteristics of an adaptive filter are adjusted automatically dependent on variations of the input signal.

In [5] a system utilizing two specially-built microphones that have good near field response and poor far field response to produce signals with noise components having high correlations is disclosed.

Document [6] uses a filter bank for band-dividing the input signal from the main microphone and the second noise component from the reference microphone, and a noise cancelling circuit for obtaining a phase difference between the input signal and the second noise component with respect to each divided band of the filter bank so as to correct the input signal based on the phase difference and for cancelling the first noise component in the input signal by use of the corrected input signal.

In [7] Hunt adopts an adaptive filtering technique which is employed using the power spectra in both channels, i.e. in a speech channel and in a reference channel, when speech is not present in the speech channel to obtain a relationship between the environmental noise power spectra in the two channels. When speech is present in the speech channel, a prediction of the environmental noise power spectrum on that channel is obtained from the power spectrum of the noise on the reference channel and the relationship between the noise power spectra on the two channels previously obtained.

In [8] a method to adjust the updating step size of the adaptive filter is proposed so that the system has a better tracking ability while the desired speech does not exist, and otherwise has a smaller residual noise while the expected speech appears.

All of the above cited documents face the disadvantage that some kind of noise, e.g. noise of some sort of machine or noise of a loudspeaker, is not considered in an appropriate and favourable way.

SUMMARY OF THE INVENTION

It is an object of the present invention to provide an acoustic noise reduction system and/or apparatus to be able to cancel narrow band and broadband noises simultaneously.

More specifically, it is an object of the invention to reduce background noise to an acceptable level even when the signal-to-noise-ratio (SNR) is low.

Another object is to provide a noise reduction system and/or apparatus which reduces audio signals from an audio source. Such an audio source drives at least one loudspeaker and is used as entertainment device in a car, in a club, at home or the like.

Yet another object of the invention is to remove the interference to the signal of the reference microphone caused by narrow band noise and audio signals.

The objects of the present invention are achieved by the features of the independent claims. Additional features result from the dependent claims.

The objects of the invention are achieved by a system for noise suppression (out) of a speech signal that is intermingled with general noise. This system comprises an Input Unit for receiving the speech signal intermingled with the general noise and at least one audio signal from an audio source, e.g. a mono or a stereo device for entertainment or the like. Furthermore, the system comprises a Processing Unit with a first adaptive filter to evaluate a first noise signal out of the audio signal and with a first calculation means to evaluate a first noise suppressed signal out of the first noise signal and the speech signal.

It is an advantage of this system, that noise coming from an audio source can be suppressed with the aid of the signal from this audio source, e.g. the signal that is sent to at least one loudspeaker connected to the audio source. Furthermore, the transfer function of this at least one loudspeaker is used to suppress the noise that the audio source produces. Here, the sound from the audio source, entertainment as music or speech, is regarded as noise that has to be suppressed in order to understand the real speech signal (intermingled with this noise) properly. This transfer function of the at least one loudspeaker can be used in a compensator unit to compensate the distortion of this at least one loudspeaker.

It should be noted that more than one loudspeaker can be provided in course of which each loudspeaker might have a different distortion and hence a separate compensation unit has to be provided. This is important for stereo audio systems, quadraphonic sound or the like. For each audio channel an adaptive filtering can be provided.

It is an embodiment that the transfer function of each loudspeaker can be calculated offline.

The invention comprises a Sound Processing Unit and a sensor in the Input Unit for measuring a rotating rate of a device, in the course of which the Sound Processing Unit generates a second noise signal of the device using the value of the sensor. This noise signal stands for a reference signal for the noise of the device because of its operation. This reference signal—evaluated from the rotation of the device—is later used to suppress the real noise that emerges from this device.

Furthermore, the system further comprises a second adaptive filter in the Processing Unit to evaluate a dynamically varying third noise signal out of the second noise signal and with a second calculation means in the Processing Unit to evaluate a second noise suppressed signal out of the third noise signal and the speech signal that is intermingled with the general noise.

It is an advantage of this system to suppress a noise signal that emerges from the rotation of a device, said device is e.g. a rotating device/machine, particularly an engine. Such an engine produces noise dependent from its revolution per time, the noise becomes sharper, particularly the frequency of the noise gets higher, when the revolutions increase. Hence the noise is directly correlated to these revolutions and measuring the revolutions, e.g. by a revolution counter, allows to determine the frequency of the noise of the engine.

From the known revolutions per time unit (e.g. minute) it is possible to generate a noise with the aid of a sound Processing Unit, e.g. a sine-wave generator. This generated noise is used to reduce the general noise of the speech signal that is intermingled with said general noise.

The speech signal intermingled with the general noise can be acquired by a microphone.

It is an embodiment of the present invention to realize said adaptive filter as an adaptive comb filter that is used to suppress the narrow band noise. Particularly, this adaptive filter can be switched on, if noise from the rotating device exists and otherwise, it can be switched off and no noise output from the Sound Processing Unit will be provided in this case.

Furthermore, objects of the invention are achieved by a system that embodies both features described above: first the suppression mechanism of the noise from the device (e.g. rotating device, engine or motor) and second the suppression mechanism of the noise of the audio signal.

It is advantageous for suppression of noise signals in an efficient way to provide a calculation system that evaluates the final noise suppressed signal in stages, first considering the noise from the device and second considering the noise of the audio signal or vice versa. It should be noted that if some kind of noise does not exist, it should not be considered in calculation. This can be achieved by a switching mechanism of the adaptive filters (on or off) dependent on the existence of the respective noise signal.

An example for implementation is a flag-mechanism: If a respective noise does not exist or is below a predefined level, the respective adaptive filter will be switched off and it won't be considered in the respective calculation unit.

Furthermore, it is an embodiment of the invention to provide an Ambient Noise Estimator within the Processing Unit. The Ambient Noise Estimator takes a background noise signal (just the background noise not the speech signal that has to be identified) into consideration. This background noise can be recorded or received by a microphone. Within the Ambient Noise Estimator a calculation takes place to suppress noise from the (rotating) device and the audio source within the background noise signal. Thus, this modified background noise signal is an estimation of the ambient noise.

As stated above, although within the Ambient Noise Estimator a switching mechanism exists calculation of the ambient noise is done dependent on the existence of the noise from the (rotating) device and/or the audio signal. This switching of the adaptive filters (see also as described above) can be done within a noise/audio signal detector wherein flags are set dependent on the existence of different kinds of noise.

It has to be emphasized that the adaptive filters can be FIR-filters and some of them can be comb-filters also.

Moreover, a voice detection unit can be provided to switch the adaptive filters within the Processing Unit dependent on the existence of the speech signal (intermingled with the general noise). Particularly, if this speech signal is below a predefined level, it is considered to be non-existent and therefore no calculation to suppress the noise within this speech signal needs to be done.

It is a result of the above described system(s) that an output signal is provided that has a better signal-to-noise-ratio than the speech signal (intermingled with general noise).

Further, the signal processing in the described system(s) is preferably done on a digital signal. Hence a conversion from analogue to digital can be done within the Input Unit. The signals acquired of the microphones are converted into digital signals as well as the analogue signals of the audio source. The generated signal of the (rotating) device can be calculated directly as a digital signal by the sine-wave generator. To achieve the object of a speech signal with suppressed noise, the digitally processed signals have to be transformed into an analogue output signal that is presented as a result of the invention.

Processing of this noise suppressed signal that can be of digital or analogue type—can be done. One possibility of processing the digital output signal is to do an automatic speech recognition. An object of such speech recognition can be a controlling of some kind of function, e.g. voice detection, recognition and control of some functions in a car while driving. Another possibility is the analogue presentation of the converted speech signal to a human listener who will be able to understand what the speaker said despite ambient noise of different types.

It is another embodiment of the present invention that the described system is a transceiver.

It is yet another embodiment of the present invention to provide a method for noise suppression to be executed on any of the above described systems.

BRIEF DESCRIPTION OP THE DRAWINGS

Examples of the present invention will be described in detail in view of the following drawings.

DETAILED DESCRIPTION OF THE DRAWINGS

Figure 1:
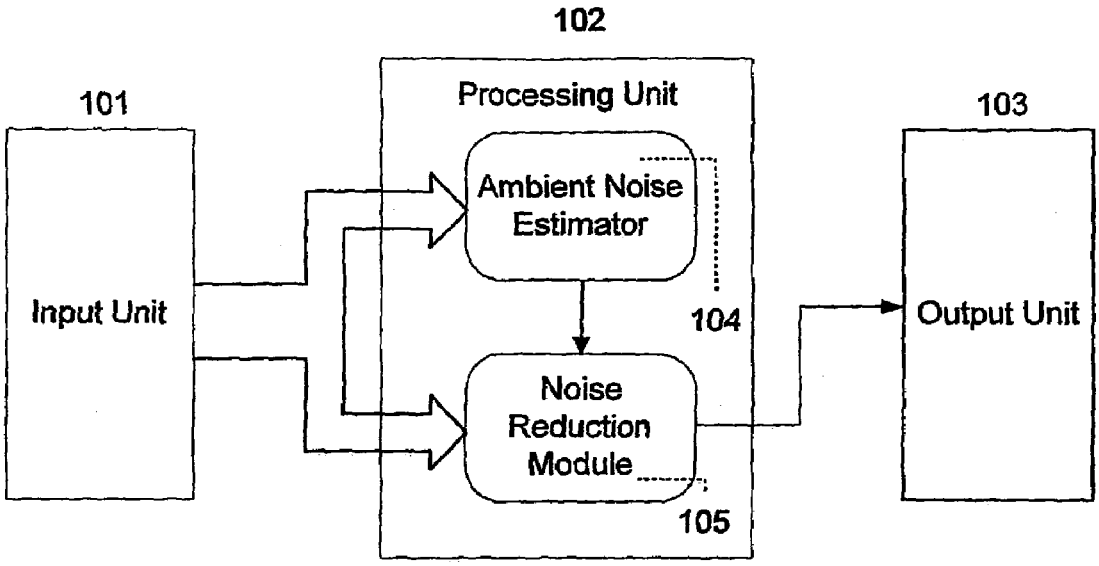
FIG. 1 shows a block diagram of the main units to achieve the goal of noise suppression.

In FIG. 1 a system composed of an Input Unit 101, a Processing Unit 102 and an Output Unit 103 is shown. The operations of the system for noise suppression and the function of each respective unit 101, 102 and 103 can be summarized as follows.

First, sensors in the Input Unit acquire signals that are processed by the system. These signals are: the speech signal intermingled with the general noise and various kinds of other signals embodying the background noise. Then those signals are, if necessary, A/D converted (see FIG. 2 for details) and input to the Processing Unit 102.

Second, the Processing Unit 102 is used to suppress the background noise of various kinds. The Processing Unit 102 can be divided into modules, i.e. an Ambient Noise Estimator 104 and a Noise Reduction Module 105. As first part of Processing Unit 102, the Ambient Noise Estimator 104 estimates the ambient noise except the noise from a (rotating) device, e.g. a rotating machine or an engine, and audio signals from an audio system, e.g. an audio entertainment device. The signals from the Input Unit 101 along with the estimated ambient noise are processed by the Noise Reduction Module 105. Finally the enhanced speech signal is converted to an analogue signal by a D/A converter (see 32 in FIG. 3) and output through the Output Unit 103.

Figure 2:
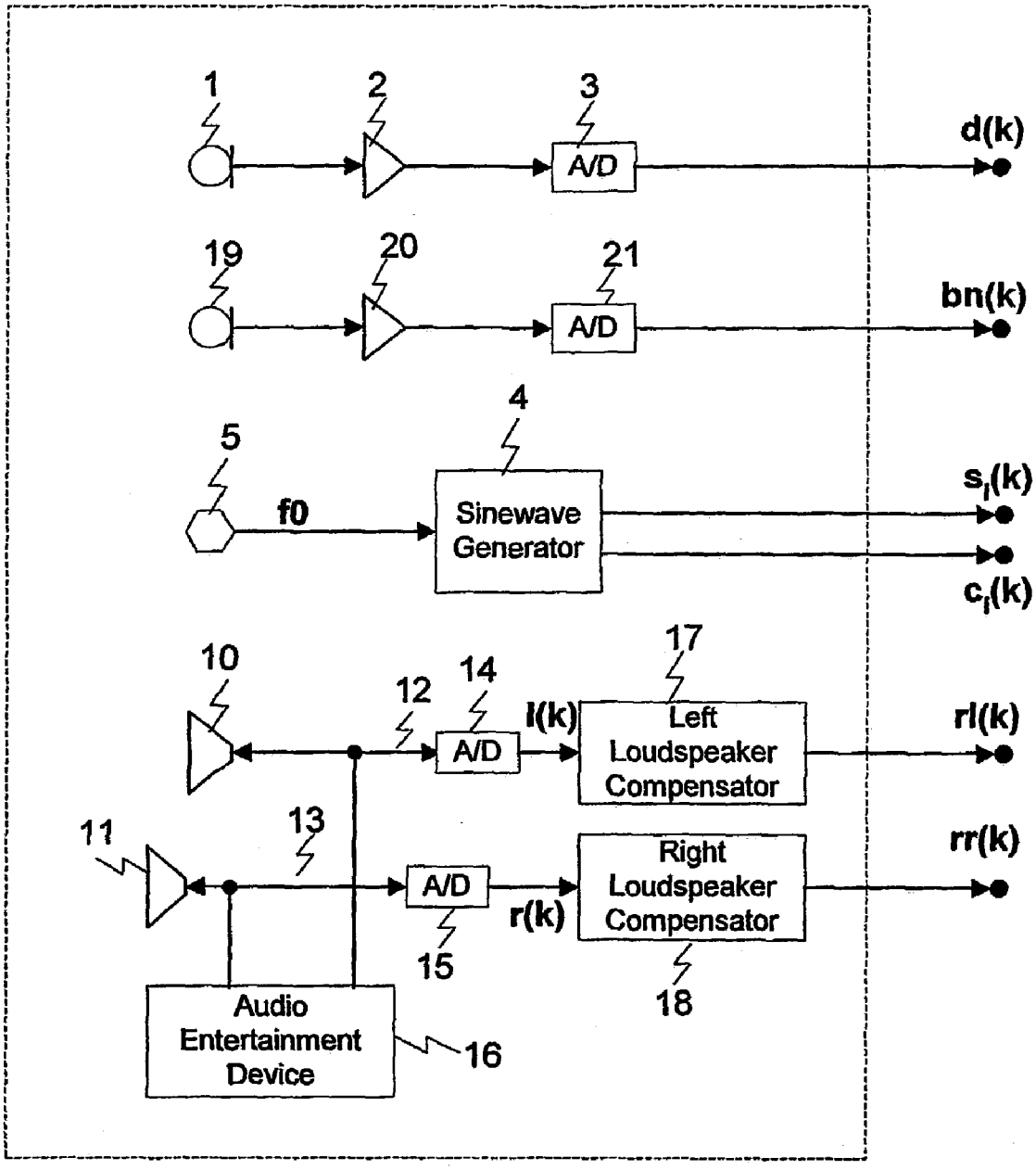
FIG. 2 shows the detailed illustration of the Input Unit of FIG. 1.
Figure 3:
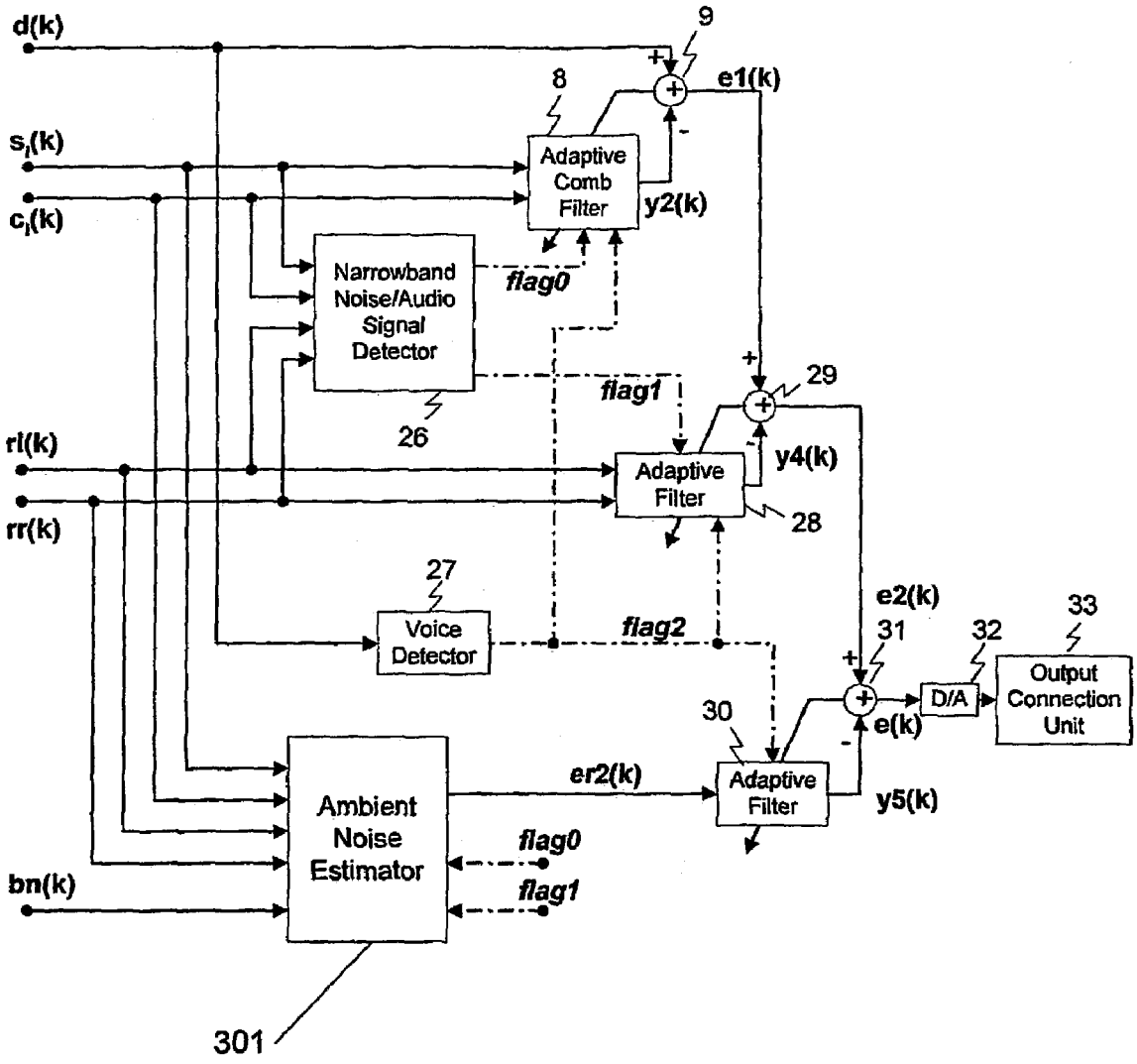
FIG. 3 shows the detail of the Processing Unit of FIG. 1.
Figure 4:
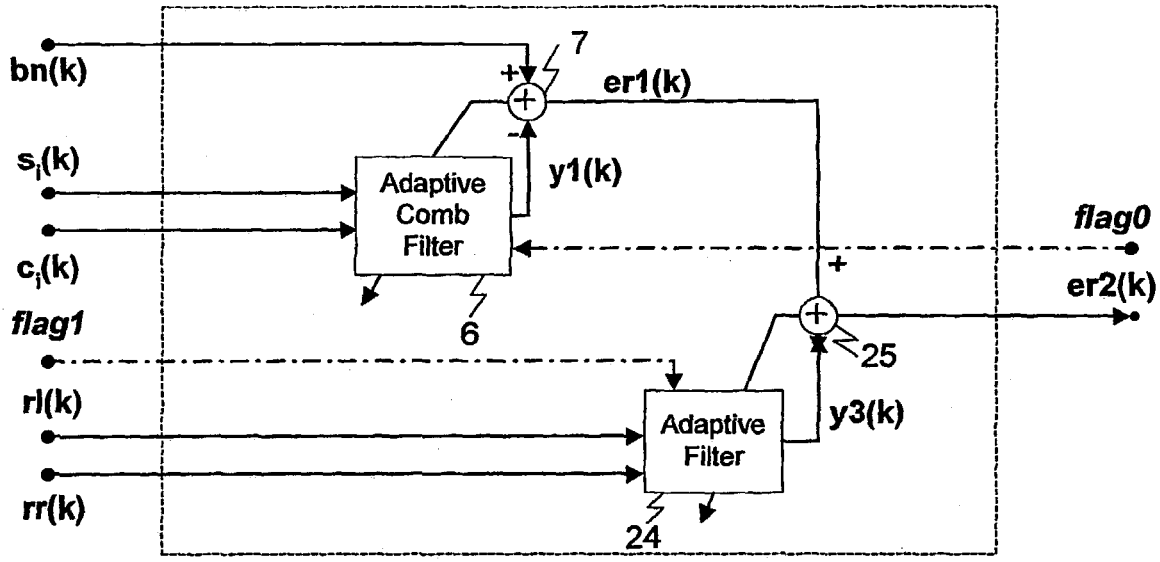
FIG. 4 shows the detail of the Ambient Noise Estimator of FIG. 3.

As shown in FIG. 2, FIG. 3 and FIG. 4, it should be emphasized that the system possesses several unique characteristics.

First, the transfer functions of the loudspeakers (see 10 and 11 in FIG. 2) are taken into account to provide better presentation of the acoustic stereo audio signals from an audio source, e.g. an audio entertainment device, as it can compensate the distortion caused by the loudspeakers. These audio signals contribute to the background noise.

Second, as shown in FIG. 3 and FIG. 4, the background noise bn(k) acquired by the reference microphone 19 contains narrow band noise from the (rotating) device, e.g. a rotating machine, acoustic audio signals from the audio source and other ambient noise. In this system, the estimated narrow band noise and audio acoustic signals are subtracted from the background noise bn(k), as a result the estimated ambient noise er2($k$) is obtained. This signal er2($k$) can be used as a reference signal for cancelling the ambient noise.

Third, the narrow-band Noise/Audio Signal Detector 26 is used to control operations of both the Ambient Noise Estimator 104 and Noise Reduction Module 105.

Other objects, features and advantages according to the present invention will be presented in the following detailed description of the illustrated embodiments when read in conjunction with the accompanying drawings.

In the previous part, the functions and operations of the system shown in FIG. 1 have been described. Now, supplementary information is provided to show the content und functionality of each unit named in FIG. 1.

In FIG. 2 the Input Unit 101 is shown, said Input Unit 101 comprising: a microphone 1, a reference microphone 19, a sensor 5 for measuring revolutions per minute (RPM) of the rotating machine, two wires 12 and 13 for acquiring a stereo audio signal from an Audio Entertainment Device 16, A/D converters 3, 21, 14 and 15, pre-amplifiers 2 and 20, loudspeaker compensators 17 and 18, and a sine-wave generator 4.

FIG. 3 shows the Processing Unit 102, comprising: an adaptive comb filter 8, adaptive filters 28 and 30, and calculations units 9, 29 and 31, further referred to as adders. The Output Unit 103 includes a D/A converter 32 and an output Connection Unit 33.

FIG. 2 shows detailed illustration of the Input Unit 101. The desired microphone 1 acquires the speech signal which is speech intermingled with general background noise. After amplified by the pre-amplifier 2, this signal is A/D converted to a digital desired signal d(k) by using the A/D converter 3.

The reference microphone 19 senses the background noise, which contains narrow-band noise from rotating machine, acoustic audio signals from audio entertainment device, and other ambient noise. This reference signal is amplified by the pre-amplifier 20 and A/D converted to a digital signal bn(k) by using A/D converter 21.

The sensor 5, which can be a tachometer, an accelerometer or the like, measures revolutions per minute (RPM) of the (rotating) device, further referred to as rotating machine. The RPM is used to compute a fundamental frequency f0 of this narrow-band noise. This fundamental frequency f0 is used to excite a sine-wave generator 4 to generate digitised sine and cosine waves with the frequency f0 and its harmonic frequencies. The sine and cosine waves are labelled si(k) and ci(k), (i=1, . . . , M), respectively, where M is the total number of the frequency components.

The signals from the audio entertainment device 16 are used to drive both loudspeakers 10 and 11 to generate the acoustic stereo audio signals. The wires 12 and 13 contain these stereo signals which are converted into digital signals using the A/D converters 14 and 15. These digitised signals are labelled l(k) and r(k), which represent the signals from the left channel and from the right channel, respectively. The left loudspeaker compensator 17 and right loudspeaker compensator 18 are used to compensate the distortion of the loudspeakers to provide better presentation of the acoustic stereo audio signals. The compensated signals are labelled rl(k) and rr(k) (second letter "11" for "left", "r" for "right").

FIG. 3 shows the Processing Unit 102 (see also FIG. 1). The adaptive comb filter 8 and two adaptive FIR filters 28 and 30 are used to reduce the background noise. The Ambient-Noise Estimator 301 (see also FIG. 4) provides a reference signal for reducing ambient noise. Two detectors, i.e. a Narrow-band Noise/Audio Signal Detector 26 (called noise detector hereafter) and a Voice Detector 27 control operation of other components within the system. Before explaining the operation of this Processing Unit 102, the control signal from both detectors 26 and 27 is defined as follows:

flag0=0 when narrow-band noise does not exist, and flag0=1 when it exists.

flag1=0 when stereo audio signals do not exist, and flag1=1 when they exist.

flag2=0 when desired voice (speech signal) does not exist, and flag2=1 when it exists.

These flags incorporate a switching mechanism dependent on the state of each flag. If some kind of noise does not exist or has a signal strength that is below a predefined level, this noise has not to be considered, i.e. no calculations for this kind of noise have to be done.

The Processing Unit 102 operates as follows: First, the speech signal d(k), which is speech intermingled with background noise, is input to both voice detector 27 and adder 9. If the desired voice (or speech) does not exists, which means flag2=0, no weight updating happens to the adaptive comb filter 8 and to the adaptive FIR filters 28 and 30. Otherwise, i.e. if speech exists, the weights of all these adaptive FIR filters are updated by using the least mean square (LMS) algorithm, in which reference and error signals are needed. At the same time the noise detector 26 finds out the existence of different kinds of noise on the basis of inputs, such as si(k) and ci(k) (i=l, . . . , M) from the rotating machine or rl(k) and rr(k) from the audio source.

If narrow-band noise does not exist, which means flag0=0, the adaptive comb filter 8, which is used to suppress the narrow-band noise would not work, so its output is defined as y2($k$)=0. Otherwise the narrow-band noise is suppressed by adaptive comb filter 8 and adder 9. The output of adder 9 is $$e\mathbf{1}(k)=d(k)-y\mathbf{2}(k). \tag{1}$$

This output signal e1($k$) is passed on to the next stage. In case that stereo audio signals do not exist, which means flag1=0, the adaptive filter 28 does not work, so its output is defined as y4($k$)=0. Otherwise, the reference audio signals rl(k) and rr(k) are processed by the adaptive filter 28 and adder 29 so as to suppress the audio signals. The output of adder 29 is $$e\mathbf{2}(k)=e\mathbf{1}(k)-y\mathbf{4}(k). \tag{2}$$

The output signal e2($k$) is passed on to the last stage of the Processing Unit 102, which comprises the adaptive FIR filter 30 and the adder 31. In this stage, the estimated ambient noise er2($k$) from Ambient Noise Estimator 301 (see FIG. 4 for details) is used as reference signal for the adaptive FIR filter 30 so as to suppress the ambient noise. The output of adder 31 is $$e(k)=e\mathbf{2}(k)-y\mathbf{5}(k). \tag{3}$$

This is the signal with desired speech enhanced and background noise suppressed.

In summary, there are three adaptive filters in this unit to suppress different kinds of background noise. There is narrowband noise, which is dealt with by the adaptive comb filter 8 and adder 9, audio signals from the audio entertainment device, which are coped with by the adaptive filter 28 and adder 29, and ambient noise, which is suppressed by the adaptive FIR filter 30 and adder 31.

FIG. 4 shows the Ambient Noise Estimator 301 in more detail. The function of this Ambient Noise Estimator 301 is to suppress the narrow band noise and the audio signals from the background noise signal bn(k), which consists of narrow band noise, audio signals and ambient noise, so as to provide an approximation of the ambient noise. The Ambient Noise Estimator 301 comprises the adaptive comb filter 6 and the adaptive FIR filter 24. The operation of this Ambient Noise Estimator 301 can be described as follows: At a first stage, if the narrow band noise exists, which means flag0=1, the adaptive comb filter 6 and adder 7 are used to suppress the narrow band noise from bn(k). Otherwise the adaptive comb filter 6 would not work, and y1($k$)=0. The output of adder 7 is $$er\mathbf{1}(k)=bn(k)-y\mathbf{1}(k). \tag{4}$$

This signal is passed on to a second stage. Here, if the audio signals exist, which means flag1=1, the adaptive FIR filter 24 and adder 25 are used to suppress the audio signals from er1($k$). In case the audio signals do not exist, which means flag1=0, the adaptive FIR filter 24 would not work and y3($k$)=0. The output of adder 25 is $$er\mathbf{2}(k)=e\mathbf{1}(k)-y\mathbf{3}(k). \tag{5}$$

This signal er2($k$) is the approximation of the ambient noise and the output of the Ambient Noise Estimator 301.

In summary, this Ambient Noise Estimator 301 attempts to provide the estimated ambient noise for the noise reduction module by utilizing two adaptive filters 6 and 24. The operation of these adaptive filters 6 and 24 is controlled by the flag signal from the Noise/Audio Signal Detector 26.

The enhanced speech signal from the Processing Unit 102 is output to the D/A converter 32 and sent to the Output Connection Unit 33.

From the foregoing, it can be seen that there has been provided an acoustic noise reduction system/apparatus and a method thereof, particularly useful for suppressing various kinds of noise, so as to improve the speech quality and intelligibility. Incorporated with the communication system, voice activated machinery, broadcast system or monitoring and dispatching system, it is helpful to improve their performance in noisy environment, such as in a car, on a construction site, a factory or an airplane.

BIBLIOGRAPHY

[1] Widrow et al.: "Adaptive Noise Cancelling: Principles and Applications"; Proc. of IEEE, Vol. 63, No. 12, Dec. 1975, pp. 1692–1719.

[2] U.S. Pat. No. 4,625,083 Poikela: "Voice operated Switch".

[3] U.S. Pat. No. 4,649,505 Zinser, Jr. et al.: "Two-Input Crosstalk-Resistant Adaptive Noise Canceler".

[4] U.S. Pat. No. 4,658,426 Chabries et al.: "Adaptive Noise Suppressor".

[5] U.S. Pat. No. 4,672,674 Clough et al.: "Communications Systems".

[6] U.S. Pat. No. 4,932,063 Nakamura: "Noise Suppression Apparatus".

[7] U.S. Pat. No. 5,319,736 Hunt: "System for Separating Speech from Background Noise".

[8] U.S. Pat. No. 5,727,073 Ikeda: "Noise Cancelling Method and Noise Canceler with variable Stepsize based on SNR".

The invention claimed is:

1. A System for noise suppression of a speech signal that is intermingled with general noise, said system comprising:

a) an Input Unit for receiving (1) the speech signal intermingled with the general noise;

(2) at least one audio signal from an audio source;

said Input Unit comprising a Sound Processing Unit and a sensor for measuring a rotating rate of a device, in the course of which the Sound Processing Unit generates a second noise signal of the device using the rotating rate value measured by the sensor;

b) a Processing Unit comprising (1) a first adaptive filter to produce a first noise signal from the audio signal;

(2) a first calculation means to remove the first noise signal from the speech signal, thereby producing a first noise suppressed speech signal from the speech signal;

(3) a second adaptive filter to produce a dynamically varying third noise signal from the second noise signal; and (4) a second calculation means to remove the third noise signal from the first noise suppressed speech signal, thereby producing a second noise suppressed speech signal which is a desired speech signal with the first noise signal and the third noise signal suppressed from the speech signal received by said Input Unit.

2. The system as defined in claim 1,
wherein said Input Unit comprises a) a converter to convert said audio signal into a digital audio signal;

b) a loudspeaker compensation unit that modifies the digital audio signal in such a way that a distortion of the loudspeaker, to which the audio signal is directed, is compensated.

3. The system as defined in claim 2,
wherein said audio signal is a stereo audio signal and for each channel a separate compensation unit and a separate adaptive filter is provided.

4. The system as defined in claim 2,
wherein said compensator is constructed to compensate the distortion of the loudspeaker by filtering the digital audio signal via the transfer function of the loudspeaker.

5. The system as defined in claim 4,
wherein said transfer function is evaluated offline.

6. The system as defined in claim 1,
wherein said Sound Processing Unit is a sine-wave generator.

7. The system as defined in claim 1,
wherein said device is a rotating device, particularly an engine.

8. The system as defined in claim 1,
wherein said sensor is a means to measure revolutions per minute of the device.

9. The system as defined in claim 1,
wherein said second adaptive filter is an adaptive comb filter.

10. A System for noise suppression of a speech signal that is intermingled with general noise, said system comprising:

a) an input device for receiving (1) the speech signal intermingled with the general noise;

(2) at least one audio signal from an audio source;

b) a Processing Unit comprising (1) a first adaptive filter to produce a first noise signal from the audio signal;

(2) a first calculation means to remove the first noise signal from the speech signal thereby producing a first noise suppressed speech signal from the speech signal;

(3) a second adaptive filter to produce a third noise signal from a second noise signal of a device; and (4) a third calculation means to remove the third noise signal from the first noise suppressed speech signal, thereby producing a third noise suppressed speech signal with the third noise signal and the first noise signal suppressed from the speech signal received by said input device.

11. A method for noise suppression in a speech signal intermingled with general noise to be executed on a system as defined in claim 10.

12. The system as defined in claim 10,
wherein said Processing Unit comprises a) an Ambient Noise Estimator comprising means to produce a fourth noise signal from said audio signal, the second noise signal and a background noise signal;

b) a fourth calculation means to remove the fourth noise signal from the third noise suppressed speech signal, thereby producing a fourth noise suppressed speech signal.

13. The system as defined in claim 12,
wherein said Processing Unit comprises a third adaptive filter that adjusts the fourth noise signal into a modified fourth noise signal.

14. The system as defined in claim 13,
wherein said Processing Unit comprises a voice detection unit that switches the second adaptive filter, the first adaptive filter and the third adaptive filter, if the speech signal intermingled with the general noise exceeds a predefined level.

15. The system as defined in claim 12,
wherein said Ambient Noise Estimator comprises:

a) a fourth adaptive filter that modifies the second noise signal into a fifth noise signal;

b) a fifth calculation means to remove the fifth noise signal from the background noise signal, thereby producing a sixth noise signal;

c) a fifth adaptive filter that modifies the audio signal into a seventh noise signal;

d) a sixth calculation means to remove the seventh noise signal from the sixth noise signal, thereby producing the fourth noise signal from the background noise signal.

16. The system as defined in claim 15,
wherein said Noise/Audio-Signal-Detector switches the fourth adaptive filter and the fifth adaptive filter.

17. The system as defined in claim 10,
wherein said Processing Unit comprises a Noise/Audio-Signal-Detector to switch the second adaptive filter if the sensor exceeds a first predefined value and to switch the first adaptive filter if the audio signal exceeds a second predefined value.

18. The system as defined in claim 17,
wherein the first predefined value is predefined in such a way that it is exceeded if there is noise from the device.

19. The system as defined in claim 17,
wherein the second predefined value is predefined in such a way that it is exceeded if there is noise from the audio source.

20. The system as defined in claim 10,
wherein at least one of the following filters is a FIR-filter: said first adaptive filter, said third adaptive filter or said fifth adaptive filter.

21. The system as defined in claim 10,
wherein the third noise suppressed speech signal is converted into an analogue signal and transferred to an Output Unit.

22. The system as defined in claim 10,
wherein said system is a transceiver.

* * * * *